US006533538B2

(12) United States Patent
Aslam et al.

(10) Patent No.: US 6,533,538 B2
(45) Date of Patent: Mar. 18, 2003

(54) IMPELLER FOR FUEL PUMP

(75) Inventors: Mohammed Aslam, Flint, MI (US); Dale M. Pickelman, Saginaw, MI (US); Partab Jeswani, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/731,465

(22) Filed: Dec. 7, 2000

(65) Prior Publication Data

US 2002/0071758 A1 Jun. 13, 2002

(51) Int. Cl.[7] ..... F04D 5/00
(52) U.S. Cl. ..... 415/55.2
(58) Field of Search ..... 415/55.1, 55.2, 415/55.3, 55.4, 55.5, 55.6, 55.7

(56) References Cited

U.S. PATENT DOCUMENTS 3,899,266 A * 8/1975 Masai et al. ..... 415/55.1
3,968,896 A 7/1976 Giacoletti et al. ..... 220/63 R
4,325,672 A * 4/1982 Sixsmith et al. ..... 415/55.3
4,852,761 A 8/1989 Turner et al. ..... 220/85 VR
5,218,942 A 6/1993 Coha et al. ..... 123/514
5,499,900 A * 3/1996 Khmara et al. ..... 415/55.1
5,660,206 A 8/1997 Neal et al. ..... 137/592
5,702,229 A * 12/1997 Moss et al. ..... 415/55.4
5,807,068 A * 9/1998 Dobler et al. ..... 415/55.1
6,113,363 A * 9/2000 Talaski ..... 417/423.3
6,152,687 A * 11/2000 Wilhelm et al. ..... 415/55.1
6,302,639 B1 * 10/2001 Endler et al. ..... 415/55.1

* cited by examiner

*Primary Examiner*—Edward K. Look
*Assistant Examiner*—Richard A. Edgar
(74) *Attorney, Agent, or Firm*—Vincent A. Cichosz

(57) ABSTRACT

A fuel pump for a vehicle includes a pump section having a flow channel and a rotatable impeller cooperating with said flow channel to pump fuel therethrough. The fuel pump also includes a motor section disposed adjacent the pump section and having a motor to rotate the impeller. The fuel pump further includes an outlet section disposed adjacent the motor section to allow pumped fuel to exit the fuel pump. The impeller includes a plurality of blades that are generally V shaped and have thinned edges.

20 Claims, 3 Drawing Sheets

IMPELLER FOR FUEL PUMP

TECHNICAL FIELD

The present invention relates generally to fuel pumps for vehicles and, more particularly, to an impeller for a fuel pump of a vehicle.

BACKGROUND OF THE INVENTION

It is known to provide a fuel tank in a vehicle to hold fuel to be used by an engine of the vehicle. It is also known to provide a fuel pump to pump fuel from the fuel tank to the engine. One type of fuel pump is known as a high-pressure turbine fuel pump. The high-pressure turbine fuel pump typically includes an impeller rotatable between inlet and outlet plates. The impeller is of a closed vane type to improve pump efficiency and performance. The impeller has a hub portion, a plurality of blade tips extending radially from the hub portion and disposed circumferentially thereabout and a peripheral ring portion extending radially from the blade tips. However, the closed vane impeller is hampered by flow loss and has shock losses due to fluid particles that contact the blade tips of the impeller.

Therefore, it is desirable to provide an impeller for a fuel pump that reduces shock losses as fluid particles enter into the impeller from a channel in a pump section of the fuel pump. It is also desirable to provide an impeller in a fuel pump for a fuel tank in a vehicle that improves the mechanical efficiency of the high-pressure pump section of the fuel pump. It is further desirable to provide an impeller for a fuel pump which maximizes the volume of displacement between each blade.

SUMMARY OF THE INVENTION

It is, therefore, one object of the present invention to provide a new impeller in a fuel pump for a fuel tank in a vehicle.

It is another object of the present invention to provide an impeller for a fuel pump of a vehicle that reduces shock losses as the fluid particles enter into the impeller.

To achieve the foregoing objects, the present invention is a fuel pump for a vehicle including a pump section having a flow channel and a rotatable impeller cooperating with the flow channel to pump fuel therethrough. The fuel pump also includes a motor section disposed adjacent the pump section and having a motor to rotate the impeller. The fuel pump further includes an outlet section disposed adjacent the motor section to allow pumped fuel to exit the fuel pump. The impeller has a plurality of blades that are generally V shaped and have thinned edges.

One advantage of the present invention is that a new impeller for a fuel pump is provided for a vehicle. Another advantage of the present invention is that the impeller has a backside of V shaped blades brought to a thin edge to reduce shock losses as fluid particles enter into the impeller from a channel in a pump section of the fuel pump. Yet another advantage of the present invention is that the impeller maximizes the volume displacement between each blade, thereby increasing the flow path toroidal circulation within the impeller. Still another advantage of the present invention is that the impeller improves the overall mechanical efficiency of the high-pressure pump section. A further advantage of the present invention is that the impeller has a thin edged backside providing a thin blade that gives 25% higher head capability at shutoff and throughout the flow range with no increase in torque. Yet a further advantage of the present invention is that low voltage performance of the fuel pump is greatly improved versus standard straight blade technology.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
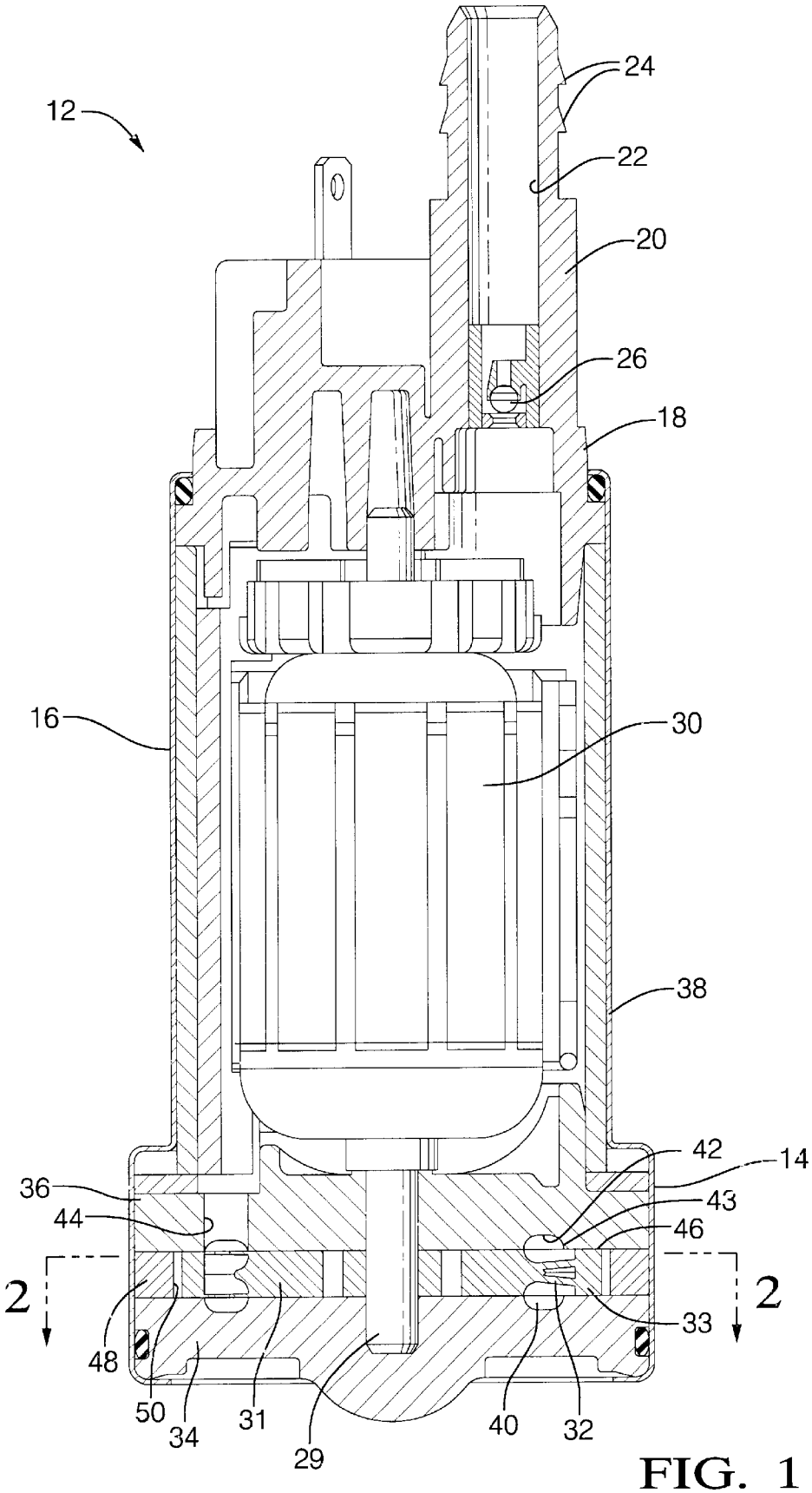
FIG. 1 is a fragmentary elevational view of a fuel pump, according to the present invention.
Figure 2:
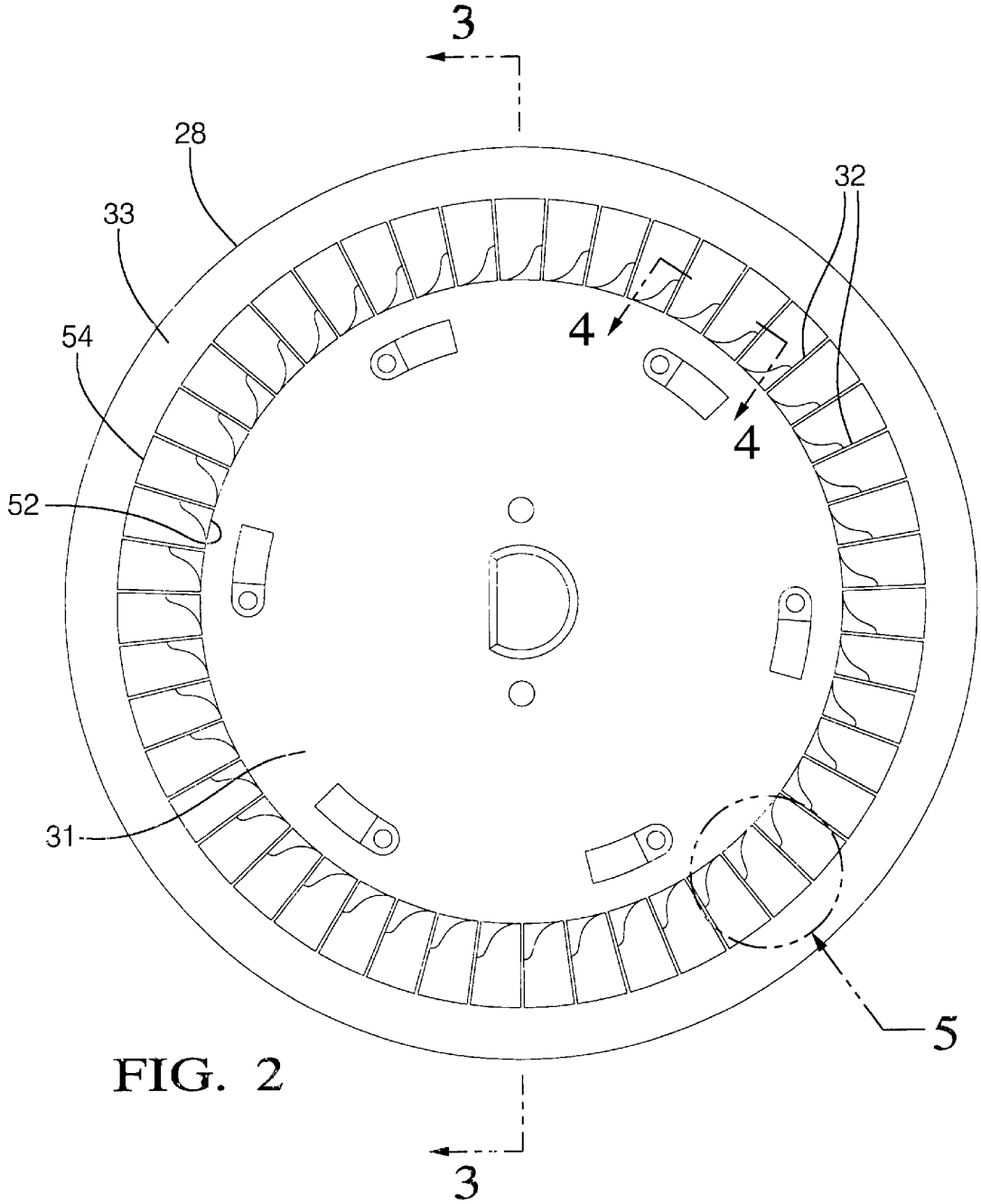
FIG. 2 is a plan view of an impeller, according to the present invention, of the fuel pump taken along line 2—2 of FIG. 1.

Referring to the drawings and in particular FIGS. 1 and 2, one embodiment of a fuel pump 12, according to the present invention, is shown for a vehicle (not shown). The fuel pump 12 includes a pump section 14 at one axial end, a motor section 16 adjacent the pump section 14, and an outlet section 18 adjacent the motor section 16 at the other axial end. As known in the art, fuel enters the pump section 14, which is rotated by the motor section 16, and is pumped past the motor section 16 to the outlet section 18. The outlet section 18 has an outlet member 20 extending axially with a passageway 22 extending axially therethrough. The outlet member 20 also has a plurality of projections or barbs 24 extending radially outwardly for attachment to a conduit (not shown). The outlet member 20 also includes a check valve 26 disposed in the passageway 22. It should be appreciated that the fuel flowing to the outlet section 18 flows into the outlet member 20 and through the passageway 22 and check valve 26 when open to the conduit. It should also be appreciated that, except for the pump section 14, the fuel pump 12 is conventional and known in the art.

Figure 3:
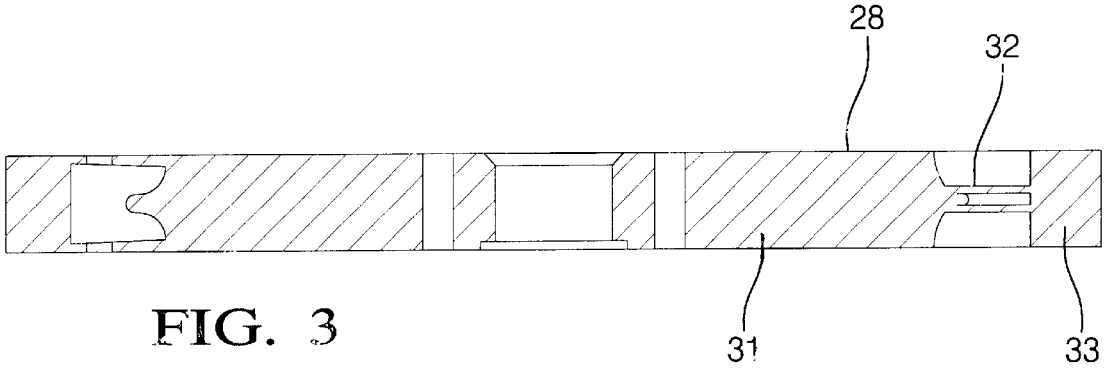
FIG. 3 is a sectional view taken along line 3—3 of FIG. 2.
Figure 4:
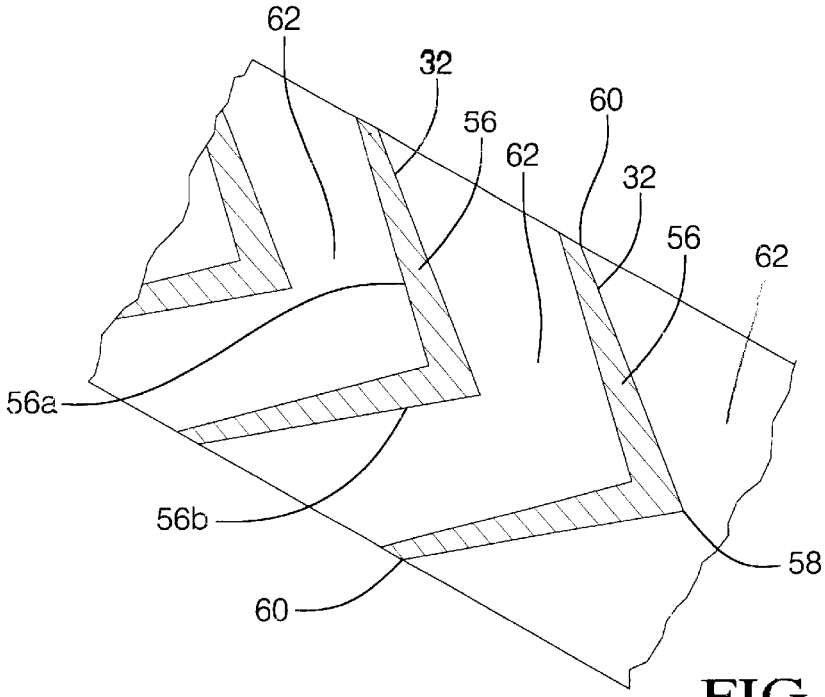
FIG. 4 is a sectional view taken along line 4—4 of FIG. 2.
Figure 5:
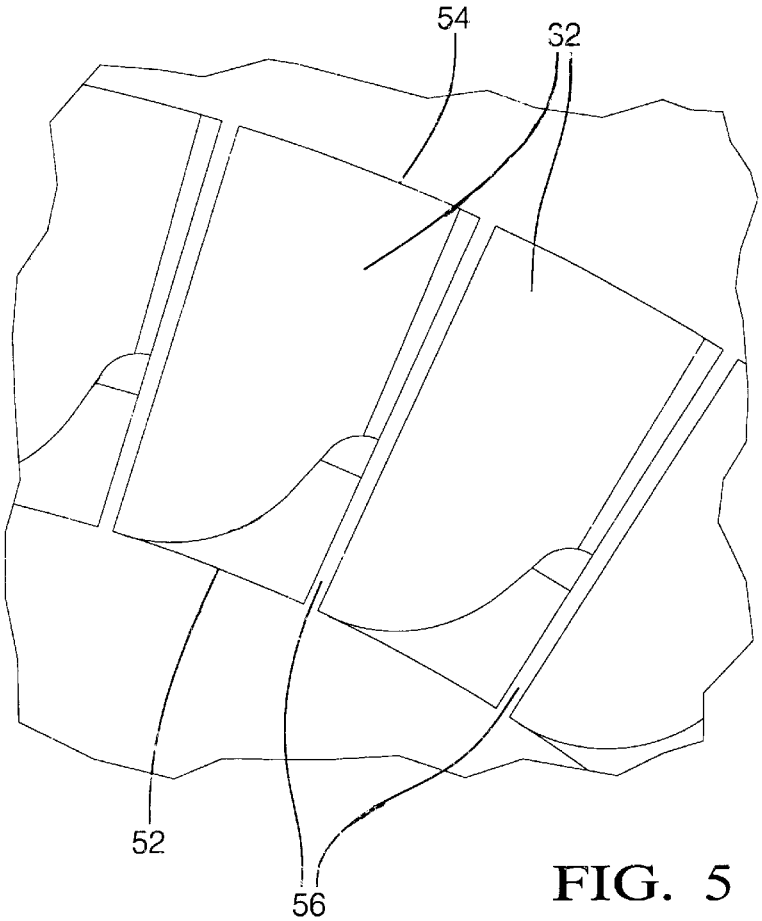
FIG. 5 is an enlarged view of a portion of the impeller in circle 5 of FIG. 2.

Referring to FIGS. 1 through 3, the pump section 14 includes an impeller 28, according to the present invention, mounted to a rotatable shaft 29 of a motor 30 of the motor section 16 for rotation therewith. The impeller 28 is generally planar and circular in shape. The impeller 28 has a hub portion 31 attached to the shaft 29 by suitable means (not shown). The impeller 28 also has a plurality of blade tips 32 extending radially from the hub portion 31 and disposed circumferentially thereabout. The impeller 28 has a peripheral ring portion 33 extending radially from the blade tips 32 to shroud the blade tips 32. The impeller 28 is made of a rigid material such as plastic.

The pump section 14 also includes an inlet plate 34 disposed axially on one side of the impeller 28 and an outlet plate 36 disposed axially on the other side of the impeller 28. The inlet plate 34 and outlet plate 36 are generally planar and circular in shape. The inlet plate 34 and outlet plate 36 are enclosed by a housing 38 and fixed thereto. The inlet plate 34 and outlet plate 36 have an inlet or first recess 40 and an outlet or second recess 42, respectively, located axially opposite the blade tips 32 adjacent to the peripheral ring portion 33 to form a flow channel 43 for a function to be described. The recesses 40 and 42 are generally annular and allow fuel to flow therethrough from an inlet port (not shown) to an outlet port 44 of the pump section 14. The peripheral ring portion 33 of the impeller 28 forms an outside diameter (OD) sealing surface 46 on both axial sides thereof with the inlet plate 34 and outlet plate 36. It should be appreciated that the impeller 28 rotates relative to the inlet plate 34 and outlet plate 36 and the inlet plate 34 and outlet plate 36 are stationary relative to the impeller 28.

The pump section 14 also includes a spacer ring 48 disposed axially between the inlet plate 34 and outlet plate 36 and spaced radially from the impeller 28 to form a gap 50 therebetween. The spacer ring 48 is fixed to the housing 38 and is stationary relative to the impeller 28. The spacer ring 48 is generally planar and circular in shape.

Referring to FIGS. 2 through 5, the blade tips 32 have an inner diameter 52 and an outer diameter 54 and extend radially between the inner diameter 52 and the outer diameter 54. The blade tips 32 of the impeller 28 each have a blade 56 that is generally "V" shaped with a leading face 56*a* and a trailing face 56*b*. The blades 56 have a blade thickness at the inner diameter 52 greater than a blade thickness at the outer diameter 54. In one embodiment, the blades 56 have a blade thickness of 0.212 inches at the inner diameter 52 and a blade thickness of 0.127 inches at the outer diameter 54. The blades 56 are tapered or angled from the inner diameter 52 to the outer diameter 54 a predetermined amount such as 1.5 degrees from a radial axis thereof. The blades 56 have a root blade thickness at 58 greater than an edge blade thickness at 60. In one embodiment, the blades 56 has a root blade thickness of 0.401 inches and an edge blade thickness 60 of 0.168 inches. The blades 56 have a predetermined blade angle such as forty-five degrees from the root blade thickness 58 to the edge blade thickness 60. The blade tips 32 also have a plurality of blade cavities 62 disposed between the blades 56. In one embodiment, the blade cavities 62 have a volume of 14.8286. It should be appreciated that fluid flows into the inlet recess 40 and through the blade cavities 62 and out the outlet recess 42.

In operation of the fuel pump 12, the motor 30 rotates the shaft 29, which in turn, rotates the impeller 28 as indicated by the arrow. The fluid velocity created at the rotating surface of the outside diameter or surface of the peripheral ring portion 33 of the impeller 28 coupled with the viscous force gradient within the fluid cause the fluid such as fuel to flow. The fuel flows from the inlet port through the flow channel 43 to the outlet port 44.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A fuel pump for a vehicle comprising:

a pump section having a flow channel and a rotatable impeller cooperating with said flow channel to pump fuel therethrough;

a motor section disposed adjacent said pump section and having a motor to rotate said impeller;

an outlet section disposed adjacent said motor section to allow pumped fuel to exit said fuel pump; and said impeller including a plurality of blades that are generally V shaped, each of said blades having a leading face and a trailing face, said leading face and said trailing face each having a planar portion extending from a root to an edge thereof and toward each other to provide a thinned edge.

2. A fuel pump as set forth in claim 1 wherein said blades have an inner diameter and an outer diameter and extend radially therebetween.

3. A fuel pump as set forth in claim 2 wherein said blades have a blade thickness at said inner diameter greater than a blade thickness at said outer diameter.

4. A fuel pump as set forth in claim 3 wherein said blades are angled from said inner diameter to said outer diameter.

5. A fuel pump as set forth in claim 1 wherein said blades have a root blade thickness greater than an edge blade thickness.

6. A fuel pump as set forth in claim 1 wherein said pump section includes an inlet plate disposed axially adjacent one side of said impeller.

7. A fuel pump as set forth in claim 6 wherein said pump section includes an outlet plate disposed axially adjacent an opposed side of said impeller.

8. A fuel pump as set forth in claim 7 wherein said impeller has an inlet surface disposed adjacent said inlet plate and an outlet surface disposed adjacent said outlet plate.

9. A fuel pump as set forth in claim 8 wherein said blades are angled at a predetermined angle from a midpoint to said inlet surface and said outlet surface.

10. A fuel pump as set forth in claim 1 including a spacer ring spaced radially from said impeller.

11. A fuel pump as set forth in claim 1 including a housing enclosing said pump section and said spacer ring being fixed to said housing and stationary relative to said impeller.

12. A fuel pump for a fuel tank in a vehicle comprising:

a housing;

a pump section disposed in said housing having a flow channel and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump; and said impeller including a plurality of blades that are generally V shaped, each of said blades having a leading face and a trailing face, said leading face and said trailing face each having a planar portion extending from a root to an edge thereof and toward each other to provide a thinned edge.

13. A fuel pump as set forth in claim 12 wherein said blades have an inner diameter and an outer diameter and extend radially therebetween.

14. A fuel pump as set forth in claim 13 wherein said blades have a blade thickness at said inner diameter greater than a blade thickness at said outer diameter.

15. A fuel pump as set forth in claim 13 wherein said blades are angled from said inner diameter to said outer diameter.

16. A fuel pump as set forth in claim 12 wherein said blades have a root blade thickness greater than an edge blade thickness.

17. A fuel pump as set forth in claim 12 wherein said pump section includes an inlet plate disposed axially adjacent one side of said impeller.

18. A fuel pump as set forth in claim 17 wherein said pump section includes an outlet plate disposed axially adjacent an opposed side of said impeller.

19. A fuel pump as set forth in claim 18 wherein said impeller has an inlet surface disposed adjacent said inlet plate and an outlet surface disposed adjacent said outlet plate.

20. A fuel pump for a vehicle comprising:

a housing;

a pump section disposed in said housing having a flow channel and a rotatable impeller cooperating with said flow channel to pump fuel therethrough, said impeller having a hub portion, a plurality of blade tips extending radially from and disposed circumferentially about said hub portion and a peripheral ring portion extending radially from said blade tips;

a motor section disposed in said housing adjacent said pump section and having a motor to rotate said impeller;

an outlet section disposed in said housing adjacent said motor section to allow pumped fuel to exit said fuel pump; and said impeller including a plurality of blades that are generally V shaped, each of said blades having a leading face and a trailing face, said leading face and said trailing face each having a planar portion extending from a root to an edge thereof and toward each other to have an edge blade thickness less than a root blade thickness.

* * * * *